US007667565B2

(12) United States Patent
Liu

(10) Patent No.: US 7,667,565 B2
(45) Date of Patent: Feb. 23, 2010

(54) CURRENT MEASUREMENT USING INDUCTOR COIL WITH COMPACT CONFIGURATION AND LOW TCR ALLOYS

(75) Inventor: Chun-Tiao Liu, Hsinchu (TW)

(73) Assignee: Cyntec Co., Ltd., Hsin-Chu (TW)

( * ) Notice: Subject to any disclaimer, the term of this patent is extended or adjusted under 35 U.S.C. 154(b) by 282 days.

(21) Appl. No.: 11/156,361

(22) Filed: Jun. 20, 2005

(65) Prior Publication Data

US 2006/0049907 A1 Mar. 9, 2006

Related U.S. Application Data

(63) Continuation-in-part of application No. 10/937,465, filed on Sep. 8, 2004, now Pat. No. 7,339,451.

(51) Int. Cl.
*H01F 5/00* (2006.01)

(52) U.S. Cl. ..... 336/200

(58) Field of Classification Search ..... 336/65, 336/83, 192, 200, 232–233, 225; 428/209; 425/209

See application file for complete search history.

(56) References Cited

U.S. PATENT DOCUMENTS

| | | | | |
|---|---|---|---|---|
| 4,020,222 | A * | 4/1977 | Kausche et al. | 428/209 |
| 4,063,211 | A * | 12/1977 | Yasujima et al. | 338/308 |
| 5,476,728 | A * | 12/1995 | Nakano et al. | 428/815 |
| 6,104,272 | A * | 8/2000 | Yamamoto et al. | 336/83 |
| 6,181,232 | B1 * | 1/2001 | Kitamura | 336/200 |
| 6,314,637 | B1 * | 11/2001 | Kimura et al. | 29/620 |
| 6,621,397 | B2 | 9/2003 | Hsu | |
| 7,034,645 | B2 * | 4/2006 | Shafer et al. | 336/83 |
| 2002/0074991 | A1 | 6/2002 | Clausse | |
| 2003/0035937 | A1 * | 2/2003 | Petkie | 428/209 |
| 2004/0209120 | A1 * | 10/2004 | Inoue et al. | 428/694 B |
| 2005/0258930 | A1 * | 11/2005 | Ishida et al. | 338/309 |

FOREIGN PATENT DOCUMENTS

| | | | |
|---|---|---|---|
| CN | 2111527 | | 7/1992 |
| CN | 1490824 | | 4/2004 |
| JP | 08031673 | A | 2/1996 |
| JP | 2000232028 | | 8/2000 |
| JP | 2001196541 | A * | 7/2001 |
| JP | 2002228688 | | 8/2002 |
| JP | 2004115311 | | 4/2004 |
| TW | 366421 | | 8/1999 |
| TW | 501150 | | 9/2002 |
| TW | 503408 | | 9/2002 |

* cited by examiner

*Primary Examiner*—Tuyen Nguyen
(74) *Attorney, Agent, or Firm*—Winston Hsu

(57) ABSTRACT

This invention discloses an inductor that includes a conducting wire composed of an alloy having temperature coefficients of resistance (TCR) 700 ppm/° C. or lower. The inductive coil has a winding configuration provided for enclosure in a substantially rectangular box with a mid-plane extended along an elongated direction of the rectangular box wherein the conducting wire intersecting at least twice near said mid-plane.

15 Claims, 11 Drawing Sheets

CURRENT MEASUREMENT USING INDUCTOR COIL WITH COMPACT CONFIGURATION AND LOW TCR ALLOYS

This Patent Application is a Continuous in Part Application (CIP) and claims the Priority Date of a patent application Ser. No. 10/937,465 filed on Sep. 8, 2004, now U.S. Pat. No. 7,339,451, by one of the co-inventors of this Application.

BACKGROUND OF THE INVENTION

1. Field of the Invention

This invention relates generally to the device configuration and processes for manufacturing inductor coils. More particularly, this invention relates to an improved configuration, process and materials for manufacturing compact inductor coils applicable for accurate current measurements.

2. Description of the Prior Art

For those of ordinary skill in the art, an inductive coil is usually not suitable for current measurement due to the variation of resistance with temperature. Specifically, an inductive coil is generally made with copper coils. Since the copper has a relative high temperature coefficient of resistance (TCR), as the current passes through the copper coils, the coils experience a temperature rise. A higher temperature in turn causes a higher resistance in the coils with a positive TCR. The variation of the resistance in turn causes a change in the current conducted in the coils. For these reasons, in order to measure a direct current conducted in the coils, a separate resistor that is serially connected to the coils is often required.

Additionally, the configurations and the process of manufacturing a high current inductor coil are still faced with technical challenges that inductor coils manufactured with current technology still does not provide sufficient compact form factor often required by application in modern electronic devices. Furthermore, conventional inductor coils are is still manufactured with complicate manufacturing processes that involve multiple steps of epoxy bonding and wire welding processes.

Shafer et al. disclose a high current low profile inductor in a U.S. Pat. No. 6,204,744, as that shown in FIG. 1. The inductor disclosed by Shafer et al. includes a wire coil having an inter coil end and an outer coil end. A magnetic material completely surrounds the wire coil to form an inductor body. First and second leads connected to the inner coil end and the outer coil end respectively extend through the magnetic material to the exterior of the inductor body. As shown in FIG. 1, the inductor coil 10 is mounted on a circuit board 12. The inductor coil 10 includes an inductor body 14 that has a first lead 16 and a second lead 18 extending outwardly from the coil 10. The leads 16 and 18 are bent and folded under the bottom of the inductor body 14 and are shown soldered to a first pad and a second pad 20, 22 respectively. As shown in FIG. 1B, the inductor 10 is constructed by forming a wire coil 24 from a flat wire having a rectangular cross section. By forming the wire into a helical coil. The coil 24 includes a plurality of turns 30 and also includes an inner end 26 and an outer end 28. A lead frame 32 that includes a first lead 16, which has one end 34, welded to the inner end 26 of the coil 24. The lead frame also includes a second lead 18 which has one end 38 welded to the outer end 28 of coil 24. The leads 16 and 18 include free ends 36, 40, which are attached to the lead, frame 32. A resist welding process is applied to weld of ends 34, 38 to the inner end 26 and the outer end 28 of coil 24.

The inductor coil as shown in FIGS. 1A to 1C by Shafer et al. still have several limitations. As the wire coil 24 formed by flat wires that has stand on a vertical direction, the height of the flat wire 24 becomes an inherent limitation to the form factor of the inductor coil. Further miniaturization of the inductor coil becomes much more difficult with a vertical standing flat wire as shown in FIG. 1B. The production cost is also increased due to the requirements that the lead frame and the coil must be separately manufactured. The manufacture processes are further complicated as several welding and bonding steps are required to securely attach the welding ends of the flat wire to the welding points of the lead frame. The production yields and time required to manufacture the inductor coil are adversely affected due to the more complicate inductor configurations and multiple boding and welding manufacturing processes.

Japanese Patent Applications 2003-229311, and 2003-309024 disclose two different coil inductors constructed as conductor rolled up as an inductor coil. These inductors however have a difficulty that the inductor reliability is often a problem. Additionally, the manufacturing methods are more complicate and the production costs are high. The high production costs are caused by the reasons that the configurations are not convenient by using automated processes thus the inductors as disclosed do not enable a person of ordinary skill to perform effective cost down in producing large amount of inductors as now required in the wireless communications.

In addition to above discussed limitations, conventional inductive coils typically composed of copper that has low resistance. However, copper has a relatively large value of temperature coefficient of resistance (TCR), e.g., the TCR is about +4,300 ppm/deg. As the current passes through the inductive coil, the temperature of the inductive coil increases, thus changes the value of the resistance and that in turn changes the current passing through the inductive coil. A measurement of current may therefore incur a 0.43% error when there is one degree of change in temperature. In order to correct this potential error of current measurement, conventional techniques of measuring current conducted in the inductive coils further requires a separate resistor connected to the inductive coils as shown in FIG. 1D. FIG. 1D shows an equivalent circuit of an inductive coil 60 implemented with a voltage converter 70. In order to measure a current passing through the circuit, a separate resistor 80 of low resistance must be employed. This requirement of using a separate resistor leads to more complicate manufacturing processes, higher production costs and lower production yields.

Therefore, a need still exists in the art of design and manufacture of inductors to provide a novel and improved device configuration and manufacture processes to resolve the difficulties. In order simplify the implementation configuration with reduced cost; it is desirable to first eliminate the requirement of using a separate resistor for current measurement. It is desirable that the improved inductor configuration and manufacturing method can be simplified to achieve lower production costs, high production yield while capable of providing inductor that more compact with lower profile such that the inductor can be conveniently integrated into miniaturized electronic devices. It is further desirable the new and improved inductor and manufacture method can improve the production yield with simplified configuration and manufacturing processes.

SUMMARY OF THE PRESENT INVENTION

It is therefore an object of the present invention to provide a new inductive coil composed of alloys of low TCR such as Cu—Mn—Ni, Cu—Ni, Ni—Cr, and Fe—Cr alloys such that a high degree of current measurement accuracy can be maintained. With low value TCR the error of current measurement due to temperature variations are maintained at a very low level without requiring using a separate resistor and the above discussed difficulties and limitations as that encountered in the conventional inductive coils are resolved.

Another object of the present invention is to provide a new structural configuration and manufacture method for manufacturing an inductor with simplified manufacturing processes to produce inductors with improved form factors having smaller height and size and more device reliability. This invention discloses an inductor that includes conducting wire-winding configurations that are more compatible with automated manufacturing processes for effectively reducing the production costs. Furthermore, with enhanced automated manufacturing processes, the reliability of the inductors is significantly improved.

Briefly, in a preferred embodiment, the present invention includes a conducting wire composed of a metallic alloy with a TCR (temperature coefficient of resistance) below 700 ppm/° C. The conductive coil further has a winding configuration provided for enclosure in a substantially rectangular box. The conducting wire is molded in a magnetic bonding material comprises powdered particles with a diameter smaller than ten micrometers and coated with an insulation layer.

This invention discloses a method for manufacturing an inductor. The method includes a step of winding a conducting wire composed of a metallic alloy with a TCR (temperature coefficient of resistance) below 700 ppm/° C. The method further includes a step of molding the conducting wire in a magnetic bonding material comprises powdered particles with a diameter smaller than ten micrometers and coated with an insulation layer.

These and other objects and advantages of the present invention will no doubt become obvious to those of ordinary skill in the art after having read the following detailed description of the preferred embodiment, which is illustrated in the various drawing figures.

DETAILED DESCRIPTION OF THE PREFERRED EMBODIMENT

Figure 1A:
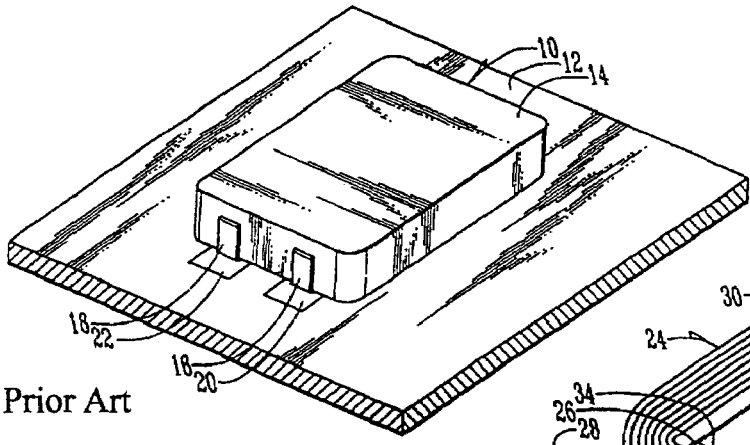
Fig. 1A Prior Art
FIGS. 1A to 1C are perspective views of an inductor of a prior art inductor formed according to a conventional manufacturing processes.
Figure 1B:
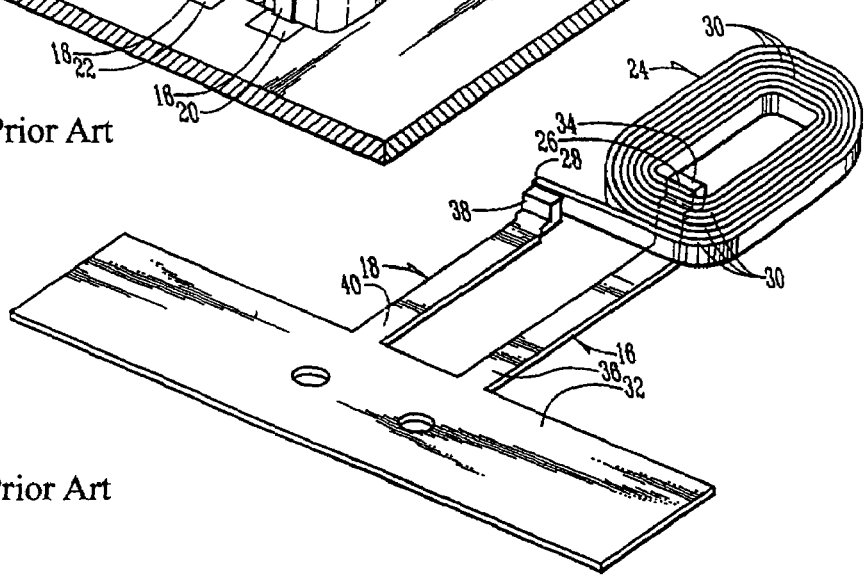
Fig.1B Prior Art
Figure 1C:
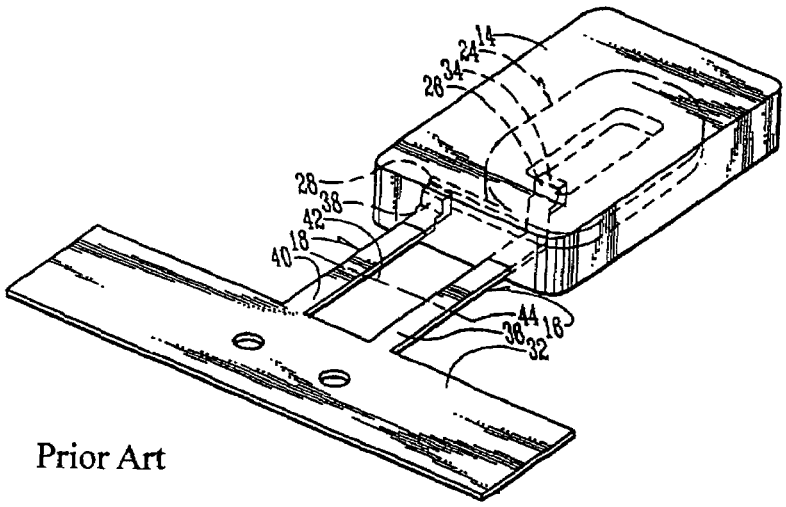
Fig. 1C Prior Art
Figure 1D:
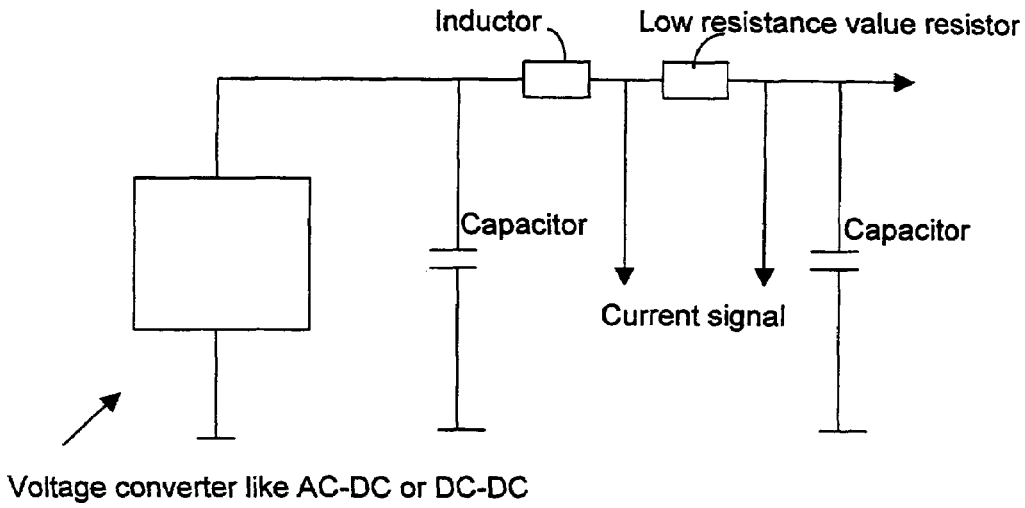
FIG. 1D is a circuit diagram showing a separated resistor of low resistance is employed for the purpose of current measurement when a conventional inductive coil is used.
Figure 2:
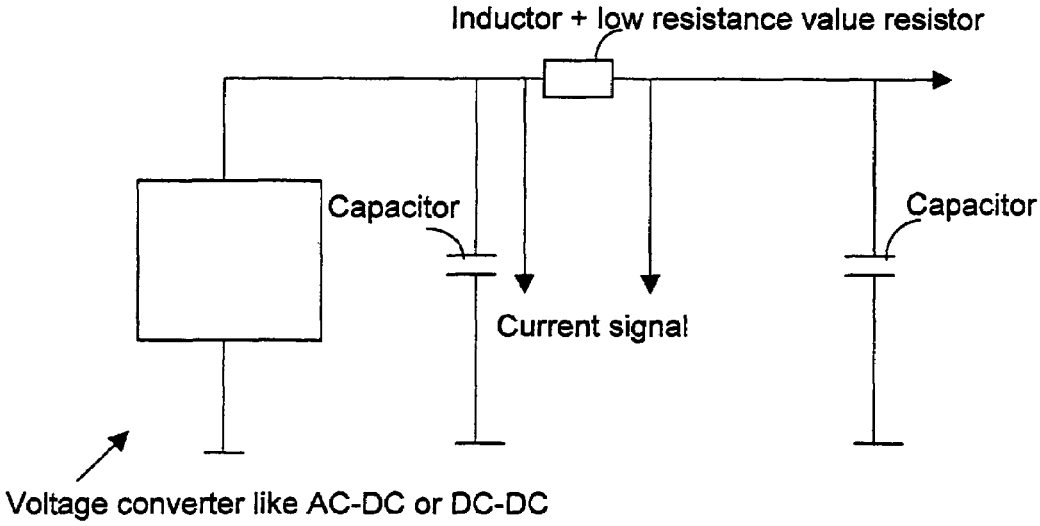
FIG. 2 is a circuit diagram of this invention wherein an inductive coil is composed of low TCR alloy for accurate current measurements without affected by temperature variations.

Referring to FIG. 2 for an improved circuit diagram with a new inductive coil 100 composed of alloys of low temperature coefficients of resistance. A separate resistor as that shown in FIG. 1D is no longer required. A current measurement can be directly performed over the inductive coil 100. An alloy of low TCR may be selected from a group of alloys that may include Cu—Mn—Ni, Cu—Ni, Ni—Cr, and Fe—Cr alloys. The table below shows some examples of alloys with achievable low TCR for each of these alloys.

| Material system | specific resistance value micro ohm-m | TCR ppm/deg |
|---|---|---|
| Cu—Mn—Ni system | 0.44 | ±10 |
| Cu—Ni system | 0.49 | ±20 |
| | 0.3 | 180 |
| | 0.15 | 420 |
| | 0.1 | 650 |
| | 0.43 | 700 |
| Ni—Cr system | 1.08 | 200 |
| | 1.12 | 260 |
| Fe—Cr system | 1.42 | 80 |

Figure 2A:
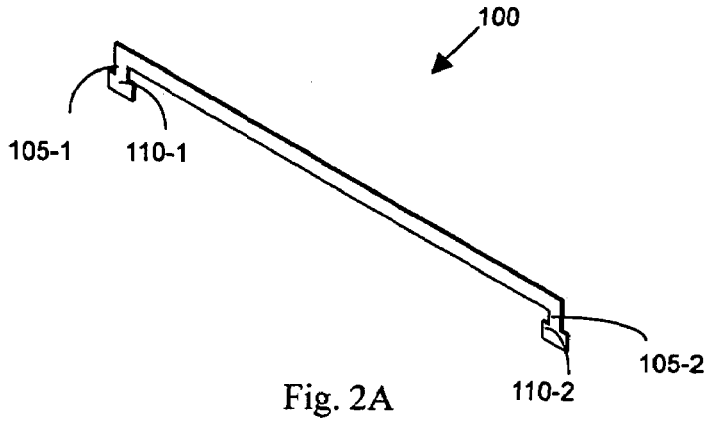
FIGS. 2A to 2D are a series of perspective views for showing the manufacturing processes to form the inductor of this invention.
Figure 2B:
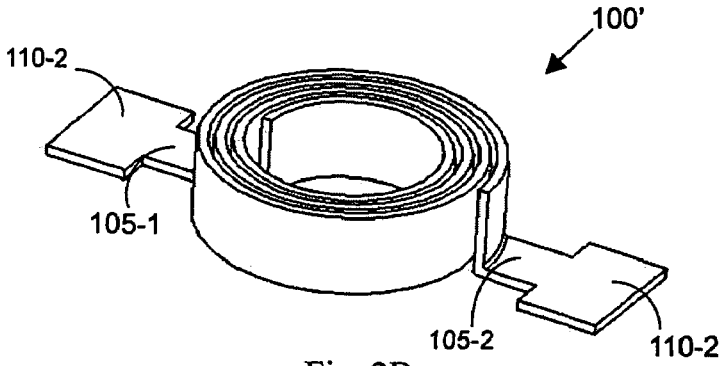

Referring to FIGS. 2A to 2D for a series of perspective views to illustrate the manufacturing processes of this invention. In FIG. 2A, a conductive flat wire 100 that includes a first terminal extension 105-1 extended from a first end of the flat wire 100 connected to a first terminal plate. The flat wire 100 further has a second terminal extension 105-2 extended from a second of the flat wire 100 and connected to a second terminal plate 110-2. In FIG. 2B, the flat wire 100 is rolled up as a coil 100' and the terminal extension 105-1 and 105-2 are bent to extend away from the first and second ends of the rolled up coil 100'. The configuration has an advantage that the manufacturing processes are simplified because the flat wire and terminals 110-1 and 110-2 can be formed by simply applying a metal pressing process. The coil further has an easily manageable form factor with a controllable outside diameter. The manufacturing processes are also simplified with requiring an electrode welding processing step thus enhance the automation of the manufacturing processes to effectively reduce the production costs.

Specifically, the flat wire 100 and the terminal extension have a rectangular cross section. An example of a preferred wire for coil 100 is an enameled copper flat wire manufactured by H.P. Reid Company, Inc., that is commercially available. The wire 100 and the extensions 105-1 and 105-2 are made from OFHC Copper 102, 99.95% pure. A polymide enamel, class 220, coats the wire for insulation. An adhesive, epoxy coat bound "E" is coated over the insulation. The wire is formed into a helical coil, and the epoxy adhesive is actuated by either heating the coil or by dropping acetone on the coil. Activation of the adhesive causes the coil to remain in its helical configuration without loosening or unwinding. The terminal plates 110-1 and 110-2 are not covered by the insulation coating and thus are ready to provide electrical contacts to the external circuits. As shown in FIG. 2B, the terminal extension 105-2 is extended from an outer end and the terminal extension 105-1 is extended from an inner end cross over the bottom of the coil 100'. The terminal plates 110-1 and 110-2 are extended away from the coil 100' and exposed without being covered by an insulation coating for ready connection to external electrical circuits.

Figure 2C:
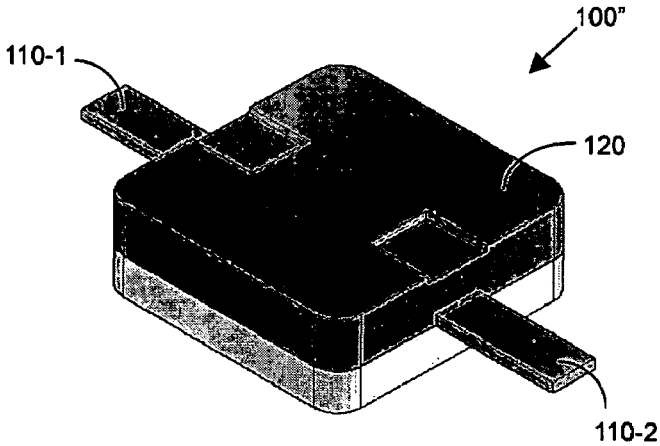
Figure 2D:
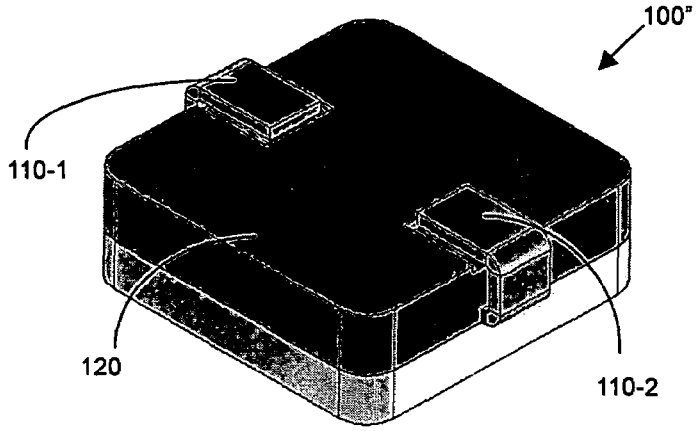

A powdered molding material (not shown) that is a highly magnetic material is poured into the coil 100' in such a manner as to completely surround the coil 100'. As shown in FIG. 2C, the coil molded with powdered material is enclosed in a box 120 with a part of the terminal extensions 105-1 and 105-2 and the terminal plates 110-1 and 110-2 extended out from the box. In FIG. 2D, the terminal plates 110-1 and 110-2 are folded onto the box to form a surface mounting inductive coil module. The inductor enclosure housing 120 is employed to contain the inductor 100' and to contain a powered magnetic molding material completely surrounding the inductor coil 100'. The magnetic molding material is employed to increase the effectiveness of the inductor. Various magnetic molding materials may be employed. Details of different preferred magnetic molding materials and method for pressure molding and bonding to the enclosure housing 140 may be found in the U.S. Pat. No. 6,204,744. U.S. Pat. No. 6,204,744 is hereby incorporated by reference in this Patent Application.

Figures 1, 3A:
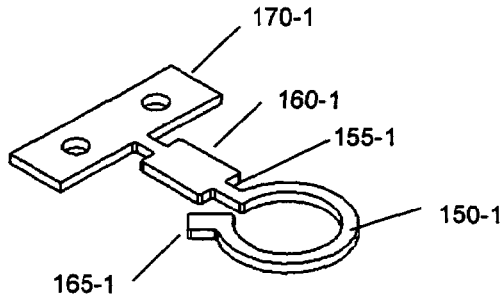
FIGS. 3A to 3D are a series of perspective views for showing the manufacturing processes to form another inductor of this invention.
Figures 2, 3A:
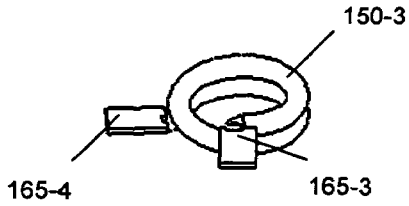
Figures 3, 3A:
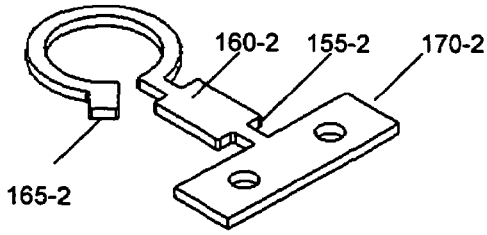
Figure 3B:
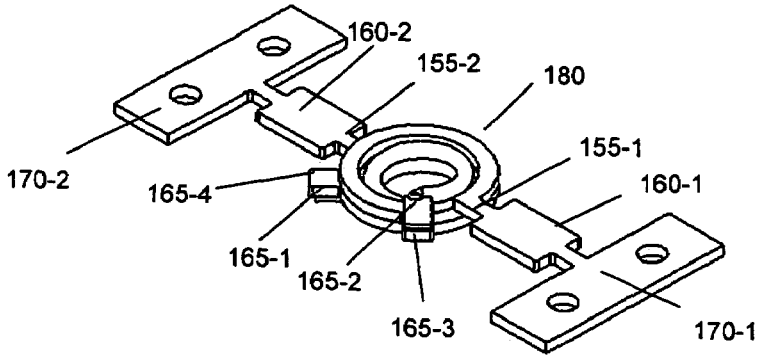

Referring to FIGS. 3A to 3D for a series of perspective views to illustrate the manufacturing processes of this invention. FIG. 3A-1 shows a conductive metal plate is punched into a bottom piece having a first circular wire 150-1 connected to a first terminal extension 155-1 extending to a first terminal plate 160-1 supported on a first lead frame 170-1. FIG. 3A-2 shows a metal plate is pressed punched into a middle piece having a middle circular wire 150-3 and two connecting plates 165-3 and 1654 at two ends. FIG. 3A-3 shows a metal plate is press punched into a top piece having a second circular wire 150-2 connected to a second terminal extension 155-2 extending to a second terminal plate 160-2 supported on a second lead frame 170-2. In FIG. 3B, the welding plate 165-2 of the top piece is welded onto the welding plate 165-3. The welding plate 1654 of the middle piece is welded onto the welding plate 165-1 of the bottom piece 150-1. Thus in FIG. 3B, the bottom, the middle and the bottom pieces are welded as an integrated coil 180.

Figure 3C:
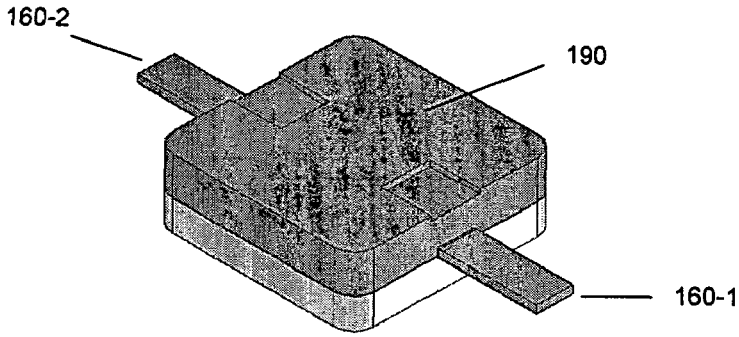
Figure 3D:
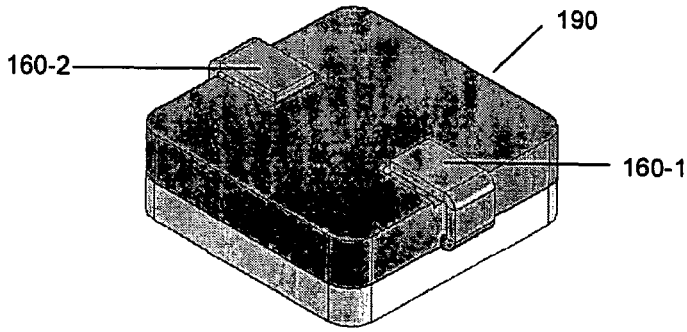

A highly magnetic powdered molding material (not shown) is poured into the inductive coil 180 in such a manner as to completely surround the coil 180. As shown in FIG. 3C, the coil molded with powdered material is enclosed in a box 190 with a part of the terminal extensions 155-1 and 155-2 and the terminal plates 160-1 and 160-2 extended out from the box. In FIG. 3D, the terminal plates 160-1 and 160-2 are folded onto the box to form a surface mounting inductive coil module.

Figures 1, 4A:
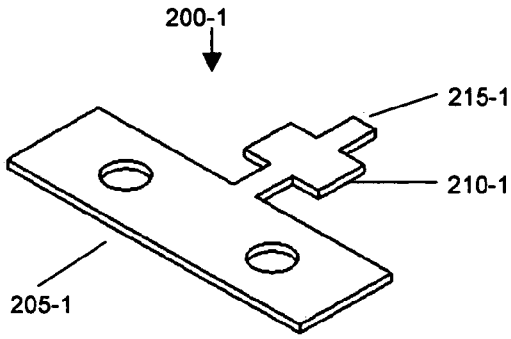
FIGS. 4A to 4G are a series of perspective views for showing the manufacturing processes to form another inductor of this invention.
Figures 2, 4A:
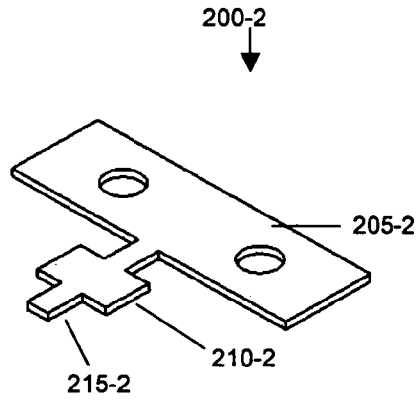
Figure 4B:
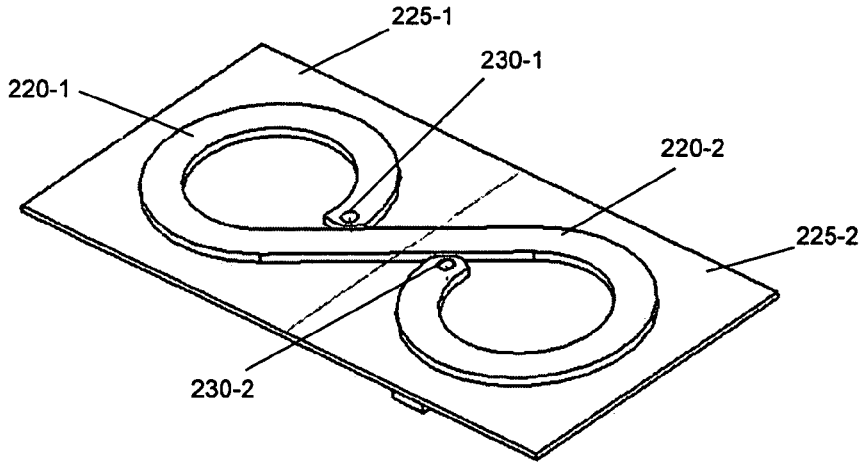
Figure 4C:
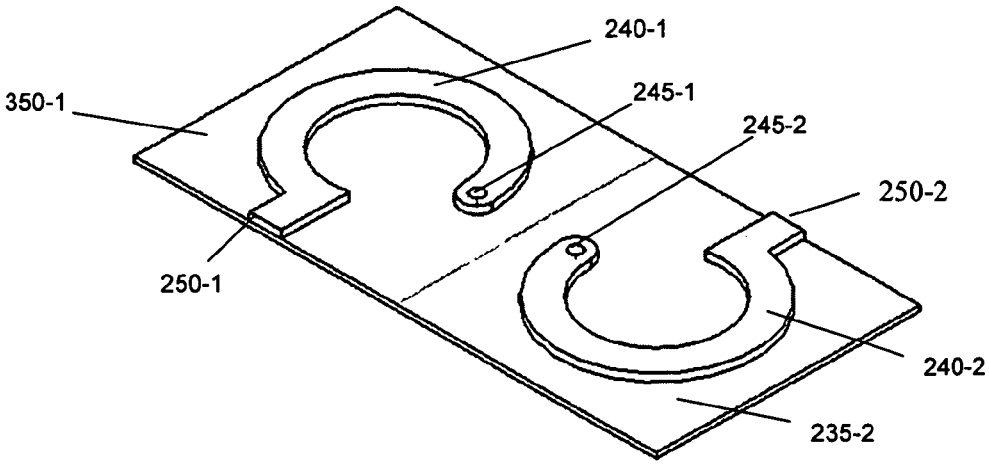
Figure 4D:
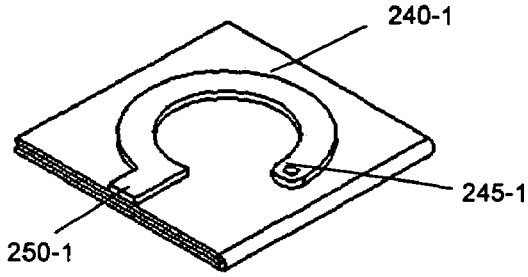
Figure 4E:
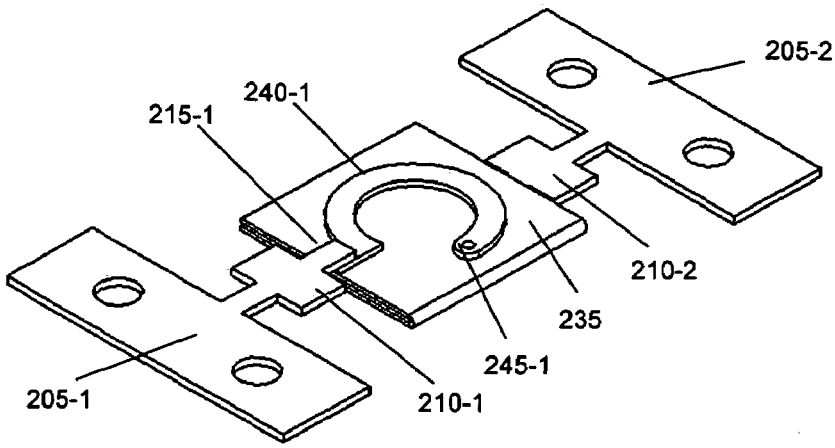

Referring to FIGS. 4A to 4G for a series of perspective views to illustrate the manufacturing processes of this invention. In FIGS. 4A-1 and 4A-2 two pieces of conductive plates are press-punched into a first and a second terminal connection frames 200-1 and 200-2 respectively. The first and second terminal connection frames 200-1 and 200-2 each includes a base plate 205-1 and 205-2 with an extension connected to a terminal plate 210-1 and 210-2 with a welding extension 215-1 and 215-2. FIG. 4B shows an inner wire coil pair that includes a first circular wire 220-1 having a first welding end-point 230-1 and a second circular wire 220-2 having a second welding point 230-1 are disposed on a foldable printed circuit board 225-1 and 225-2. FIG. 4C shows an outer wire coil pair that includes a first hook-shaped wire 240-1 having a first welding end-point 245-1 and a second hook-shaped wire 240-2 having a second welding point 245-1 are disposed on a foldable printed circuit board 235-1 and 235-2. FIG. 4D shows a combined coil formed by folding the inner printed circuit board 225-1 and 225-2 first and the then folding the outer printed circuit board 235-1 and 235-2 wrapping over the inner folded circuit board. The outer folded inner PCB 235-1 is now placed on top of the folded inner PCB 225-1 with the first welding end point 245-1 welded to the first inner welding end point 230-1. The outer folded inner PCB 235-2 is now placed below the folded inner PCB 225-2 with the second welding end point 245-2 contacts and welded to the second inner welding end point 230-2. FIG. 4E shows the terminal connection frame 200-1 and 200-2 are welded onto the combined coil with the first welding end point of the first terminal connection frame 215-1 welded onto the welding end point 250-1 and the second terminal connection frame 215-2 welded onto the welding end point 250-2. The coil inductor as shown are disposed on the printed circuit board and simplifying both the design and also the manufacturing processes.

Figure 4F:
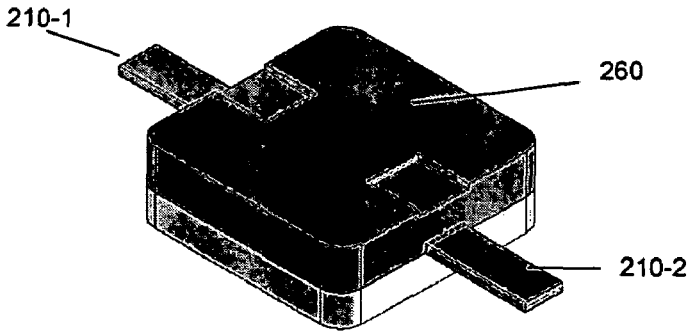
Figure 4G:
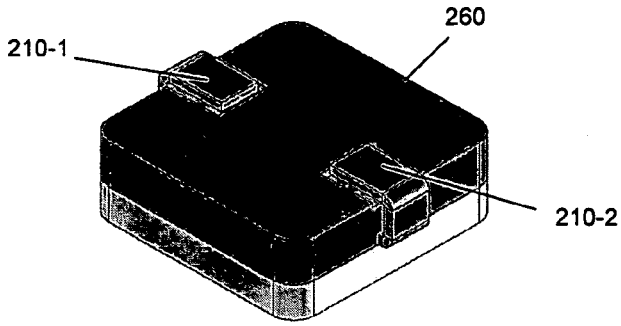

A highly magnetic powdered molding material (not shown) is poured into the combined inductive coil in such a manner as to completely surround the coil. As shown in FIG. 4F, the coil molded with powdered material is enclosed in a box 260 with a part of the terminal extensions and the terminal plates 210-1 and 210-2 extended out from the box. In FIG. 4G, the terminal plates 210-1 and 210-2 are folded onto the box 260 to form a surface mounting inductive coil module.

Figures 1, 5A:
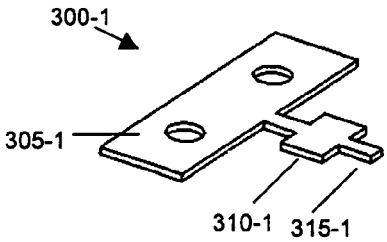
FIGS. 5A to 5F are a series of perspective views for showing the manufacturing processes to form another inductor of this invention.
Figures 2, 5A:
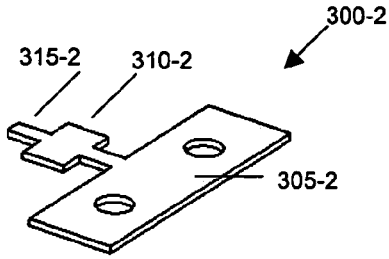
Figure 5B:
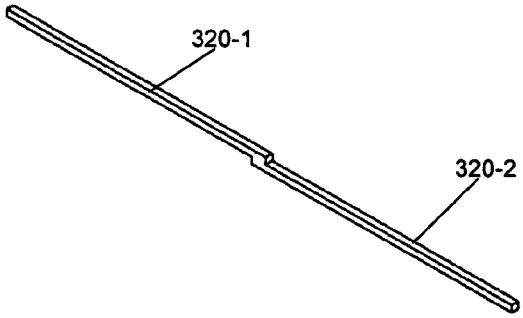
Figure 5C:
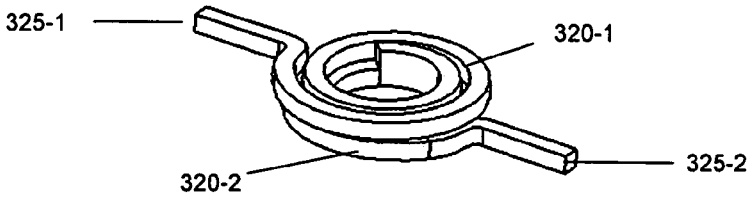
Figure 5D:
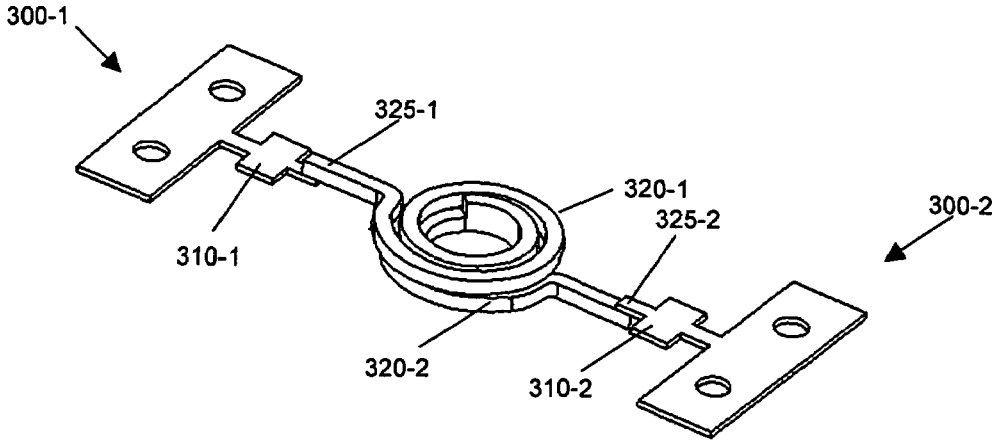

Referring to FIGS. 5A to 5F for a series of perspective views to illustrate the manufacturing processes of this invention. In FIGS. 5A-1 and 5A-2 two pieces of conductive plates are press-punched into a first and a second terminal connection frames 300-1 and 300-2 respectively. The first and second terminal connection frames 300-1 and 300-2 each includes a base plate 305-1 and 305-2 with an extension connected to a terminal plate 310-1 and 310-2 with a welding extension 315-1 and 315-2. FIG. 5B shows a wire coil pair that includes a upper wire 320-1 connected to a lower wire 320 the wires 320-1 and 320-2 have a square shaped cross sectional area. In FIG. 5C, the upper wire 320 is rolled into an upper coil with an upper welding extension end 325-1. The lower wire 320-2 is rolled into a lower coil with a lower welding extension end 325-2. In FIG. 5D, the first terminal connection frame 300-1 is welded to the upper coil by welding together the welding points 315-1 to 325-1. The second terminal connection frame 300-2 is welded to the lower coil by welding together the welding points 315-2 to 325-2. The coil inductor as shown have flat wire with large cross sectional area further decreases the resistance and provides higher power utilization efficiency that becomes more important when batteries of limit capacity are commonly utilized to drive the circuits of a mobile device.

Figure 5E:
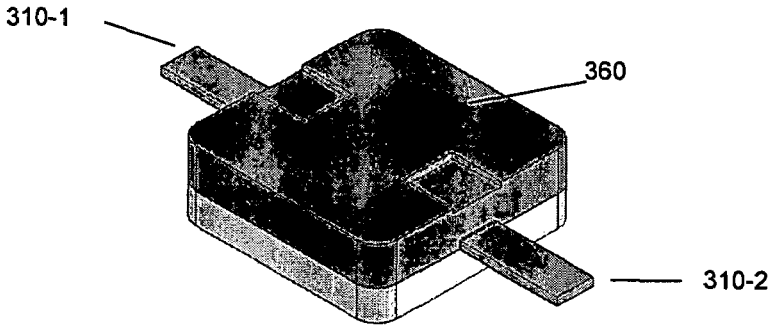
Figure 5F:
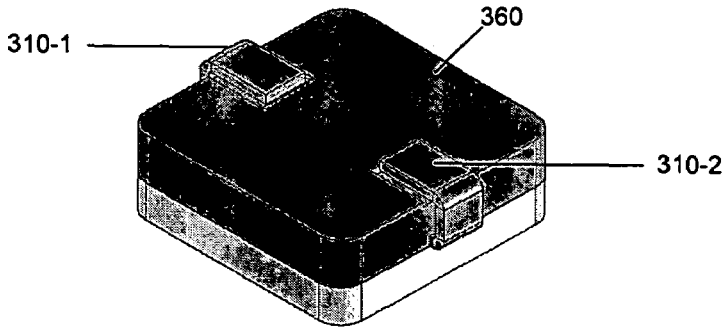

A highly magnetic powdered molding material (not shown) is poured into the combined inductive coil in such a manner as to completely surround the coil. As shown in FIG. 5E, the coil molded with powdered material is enclosed in a box 360 with a part of the terminal extensions and the terminal plates 310-1 and 310-2 extended out from the box. In FIG. 5E, the terminal plates 310-1 and 310-2 are folded onto the box 360 to form a surface mounting inductive coil module.

Figures 1, 6A:
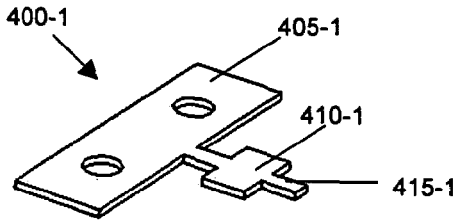
FIGS. 6A to 6G are a series of perspective views for showing the manufacturing processes to form another inductor of this invention.
Figures 2, 6A:
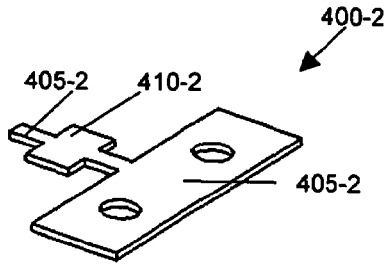
Figure 6B:
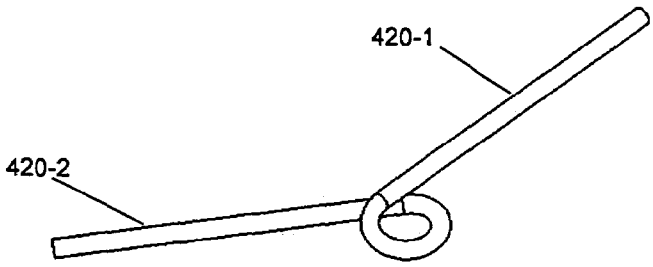
Figure 6C:
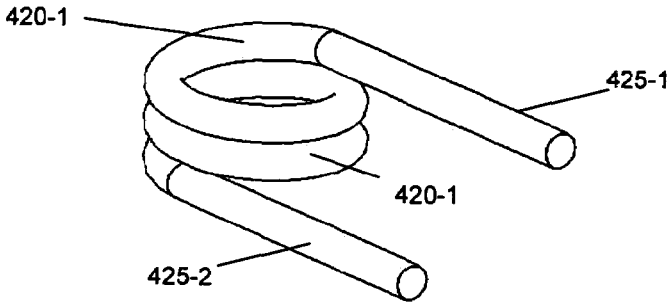
Figures 1, 6C:
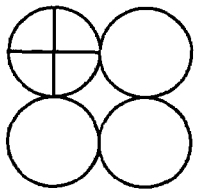
Figures 2, 6C:
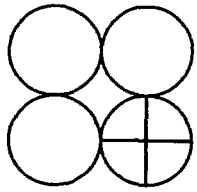
Figure 6D:
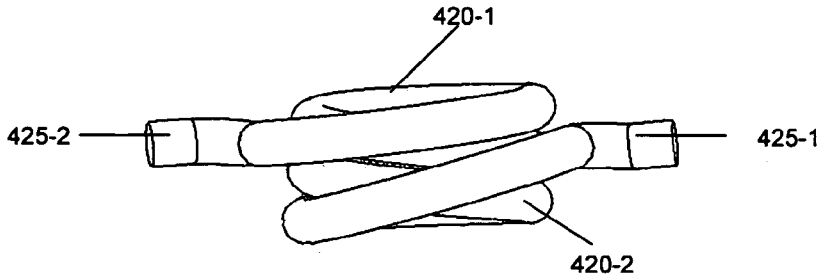
Figure 6E:
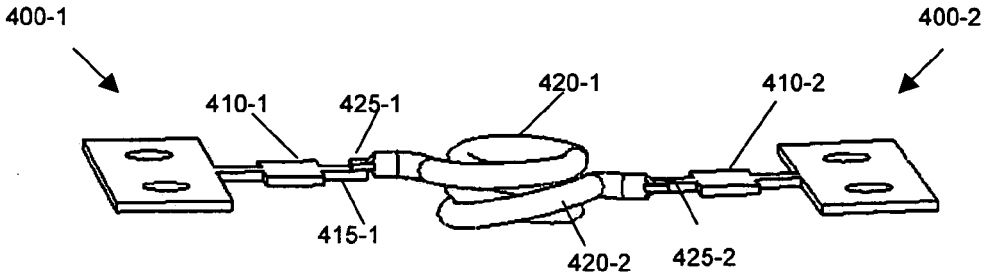

Referring to FIGS. 6A to 6F for a series of perspective views to illustrate the manufacturing processes of this invention. In FIGS. 6A-1 and 6A-2 two pieces of conductive plates are press-punched into a first and a second terminal connection frames 400-1 and 400-2 respectively. The first and second terminal connection frames 400-1 and 400-2 each includes a base plate 405-1 and 405-2 with an extension connected to a terminal plate 410-1 and 410-2 with a welding extension 415-1 and 415-2. FIG. 6B shows a flexible wire coil that includes a upper wire 420-1 connected to a lower wire 420-1 and in FIG. 5C, the upper wire 420-1 is rolled into an upper coil with an upper welding extension end 425-1. The lower wire 420-2 is rolled into a lower coil with a lower welding extension end 425-2. In FIG. 5D, the upper and the lower welding extension ends 425-1 and 425-2 are bended to extend along two opposite horizontal directions. In FIG. 6E, the first terminal connection frame 400-1 is welded to the upper coil by welding together the welding points 415-1 to 425-1. The second terminal connection frame 400-2 is welded to the lower coil by welding together the welding points 415-2 to 425-2. Instead of welding to the terminal plates, FIG. 6D-2 shows an alternate preferred embodiment where the ends of the coil wire are pressed into the terminal plates 400-1' and 400-2'. The coil inductor as configured in this preferred embodiment has the advantage that the winding configuration allows for very convenient automation process to significantly reduce the production cost. The improved automated manufacturing processes further improve the reliability of inductors produced with such configuration.

Figure 6F:
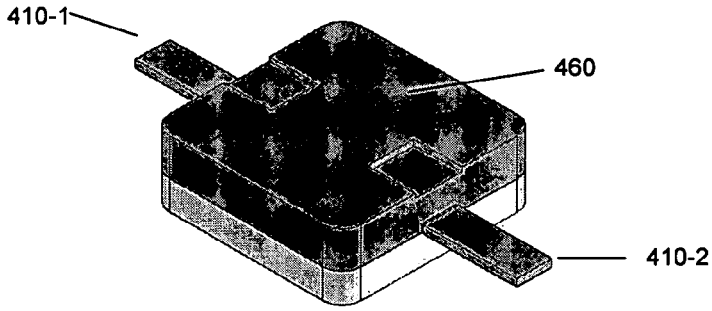
Figure 6G:
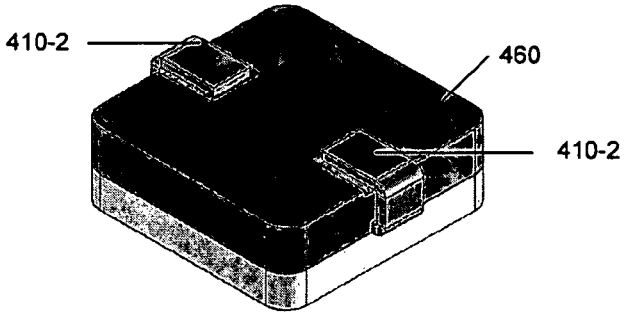

A highly magnetic powdered molding material (not shown) is poured into the combined inductive coil in such a manner as to completely surround the coil. As shown in FIG. 6F, the coil molded with powdered material is enclosed in a box 460 with a part of the terminal extensions and the terminal plates 410-1 and 410-2 extended out from the box. In FIG. 6G, the terminal plates 410-1 and 410-2 are folded onto the box 460 to form a surface mounting inductive coil module.

When compared to other inductive components the inductor of the present invention has several unique attributes. The conductive winding and the leads are formed with a simplified structure thus having excellent connectivity and supreme reliability. The manufacturing processes for forming conductive winding are much simplified. Furthermore, the conductive winding the lead together with the magnetic core material, and protective enclosure are molded as a single integral low profile unitized body that has termination leads suitable for surface mounting. The construction allows for maximum utilization of available space for magnetic performance and is self shielding magnetically.

The simplified manufacturing process of the present invention provides a low cost, high performance and highly reliable package. Simplified process with reduced welding requirements increase the production yields and reduces the production costs. The inductor is formed without the dependence on expensive, tight tolerance core materials and special winding techniques. The conductive coils as disclosed functioning as conductive winding of this invention allows for high current operation and optimizes the magnetic parameters by using magnetic molding material for surrounding and bonding the conductive windings. By applying suitable magnetic bonding materials as the core material, it has high resistivity that exceeds three mega ohms that enables the inductor to carry out the inductive functions without a conductive path between the leads that can be connected to various circuits either by surface mounting or pin connections. It is flexible to use different magnetic material to allow the inductor for applications in circuits operable at different level of frequencies. The inductor package performance according to this invention yields a low DC resistance to inductance ratio, e.g., 2 milli-Ohms per micro-Henry, that is well below a desirable ratio of 5 for those of ordinary skill in the art for inductor circuit designs and applications.

For the purpose of further improving the performance inductors, a special magnetic molding and bonding material is employed that includes carbonyle iron powder. The diameter of the powder particle is less then ten micrometers. The smaller the size of the particles, the smaller is the magnetic conductance of these particles and the greater is the saturation magnetization. For the purpose of optimizing the performance of the inductor, there must be a balance between these two parameters. In the present invention, a particle size with a diameter under 10 μm provides near optimal eddy current. As further discussed below a greater eddy current improves the magnetic saturation current of the powdered particles when coated with insulation layer. The powder particles are coated with an insulation layer comprising materials of polymer of sol gel. The resistance of these insulation coating materials are at least 1M ohms and preferably greater than 10M ohms. Such insulation coated particles have a special advantages that the inductor has greater saturation current. The inductor as disclosed in this invention when molded with powdered particles of magnetic material coated with the insulation layer can provide more stable operation when there are current fluctuations. The advantage is critically important for a system operated with larger currents. Additionally, with greater saturation current, the inductor of the present invention is able to provide better filtering performance and is able to store larger amount of energy.

According to above descriptions, this invention discloses an inductor that includes a conducting wire having a winding configuration provided for enclosure in a substantially rectangular box. The conducting wire is molded in a magnetic bonding material comprises powdered particles with a diameter smaller than ten micrometers and coated with an insulation layer. In a preferred embodiment, the powdered particles of the magnetic bonding material comprise carbonyle iron particles. In another preferred embodiment, the insulation layer comprises a layer with a resistance substantially greater than 1M ohms. In another preferred embodiment, the insulation layer comprises a layer with a resistance about 10M ohms. In another preferred embodiment, the insulation layer comprises a polymer layer. In another preferred embodiment, the insulation layer comprises a sol gel layer. In another preferred embodiment, the conducting wire having a winding configuration provided for enclosure in a substantially rectangular box. In another preferred embodiment, the conducting wire having a winding configuration with a mid-plane extended along an elongated direction of the rectangular box wherein the conducting wire intersecting at least twice near the mid-plan provided for enclosure in a substantially rectangular box. In another preferred embodiment, the conducting wire having a first flattened terminal end and a second flattened terminal end for extending out from an enclosure housing to function as a first and second electrical terminals to connect to an external circuit. In another preferred embodiment, the conducting wire having a first welding terminal and a second welding terminal for extending out from an enclosure housing for welding to a lead frame.

Although the present invention has been described in terms of the presently preferred embodiment, it is to be understood that such disclosure is not to be interpreted as limiting. Various alternations and modifications will no doubt become apparent to those skilled in the art after reading the above disclosure. Accordingly, it is intended that the appended claims be interpreted as covering all alternations and modifications as fall within the true spirit and scope of the invention.

I claim:

1. An inductor comprising:

a conducting wire composed of a metallic alloy having temperature coefficients of resistance (TCR) 700 ppm/° C. or lower, wherein said conducting wire has a specific resistance value of 1.42 μΩm or lower, wherein the inductor is used in making accurate current measurements due to the TCR of the conducting wire.

2. The inductor of claim 1 wherein:

said conducting wire having a winding configuration provided for enclosure in a substantially rectangular box.

3. The inductor of claim 2 wherein:

said conducting wire is molded in a magnetic bonding material comprising powdered particles with a diameter smaller than ten micrometers and coated with an insulation layer.

4. The inductor of claim 3 wherein:

said powdered particles of said magnetic bonding material comprising carbonyle iron particles.

5. The inductor of claim 3 wherein:

said insulation layer comprising a layer with a resistance substantially greater than 1M ohms.

6. The inductor of claim 3 wherein:

said insulation layer comprising a layer with a resistance about 10M ohms.

7. The inductor of claim 3 wherein:

said insulation layer comprising a polymer layer.

8. The inductor of claim 3 wherein:

said insulation layer comprising a sol gel layer.

9. The inductor of claim 1 wherein:

said conducting wire having a winding configuration with a mid-plane extended along an elongated direction of a substantially rectangular box wherein said conducting wire intersecting at least twice near said mid-plan provided for enclosure in said substantially rectangular box.

10. The inductor of claim 1 wherein:

said conducting wire having a first flattened terminal end and a second flattened terminal end for extending out from an enclosure housing to function as a first and second electrical terminals to connect to an external circuit.

11. The inductor of claim 1 wherein:

said conducting wire having a first welding terminal and a second welding terminal for extending out from an enclosure housing for welding to a lead frame.

12. The inductor of claim 1 wherein:

said conducting wire composed of a Cu—Mn—Ni metallic alloy.

13. The inductor of claim 1 wherein:

said conducting wire composed of a Ni—Cr metallic alloy.

14. The inductor of claim 1 wherein:

said conducting wire composed of a Cu—Ni metallic alloy.

15. The inductor of claim 1 wherein:

said conducting wire composed of a Fe—Cr metallic alloy.

* * * * *

UNITED STATES PATENT AND TRADEMARK OFFICE

CERTIFICATE OF CORRECTION

PATENT NO. : 7,667,565 B2
APPLICATION NO. : 11/156361
DATED : February 23, 2010
INVENTOR(S) : Chun-Tiao Liu It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 426 days.

Signed and Sealed this

Twenty-eighth Day of December, 2010

David J. Kappos

David J. Kappos
*Director of the United States Patent and Trademark Office*